United States Patent [19]

Patterson

[11] Patent Number: 4,676,507

[45] Date of Patent: Jun. 30, 1987

[54] PUZZLES FORMING PLATONIC SOLIDS

[76] Inventor: Bruce D. Patterson, Zelgmatt 21, CH-8132 Egg, Switzerland

[21] Appl. No.: 731,027

[22] Filed: May 6, 1985

[51] Int. Cl.[4] ..... A63F 9/12

[52] U.S. Cl. ..... 273/160; 446/125

[58] Field of Search ..... 273/157 R, 160; 52/DIG. 10; 446/124, 125

[56] References Cited

U.S. PATENT DOCUMENTS

| | | | |
|---|---|---|---|
| 1,471,943 | 10/1923 | Chambers . | |
| 2,041,030 | 5/1933 | Strutton . | |
| 3,461,574 | 7/1967 | Larson et al. . | |
| 3,546,792 | 6/1968 | Sherman . | |
| 3,565,442 | 2/1971 | Klein . | |
| 3,645,535 | 2/1972 | Randolph . | |
| 3,659,360 | 5/1972 | Zeischegg . | |
| 3,840,234 | 10/1974 | Felsten . | |
| 3,885,794 | 5/1975 | Coffin . | |
| 4,121,831 | 10/1978 | Greene | 273/160 |
| 4,133,538 | 1/1979 | Ambrose . | |
| 4,153,254 | 5/1979 | Marc . | |
| 4,258,479 | 3/1981 | Roane . | |
| 4,323,245 | 4/1982 | Beaman . | |
| 4,597,579 | 7/1986 | Walton | 273/160 |

OTHER PUBLICATIONS

Fall 1983 Smithsonian Catalogue, unnumbered page.

*Primary Examiner*—Anton O. Oechsle

*Attorney, Agent, or Firm*—Roylance, Abrams, Berdo & Goodman

[57] ABSTRACT

A three-dimensional puzzle in the shape of a Platonic solid is formed by six identical pieces. The puzzle can be in the form of a tetrahedron, a cube, an octahedron, a dodecahedron, or an icosahedron. Each puzzle has six identically shaped, three-dimensional pieces which interlock to form the solid and retain the pieces in their relative positions. Although the pieces of each puzzle are identical, the pieces of the different puzzles are differently shaped.

50 Claims, 16 Drawing Figures

PUZZLES FORMING PLATONIC SOLIDS

FIELD OF THE INVENTION

The present invention relates to three-dimensional puzzles wherein each puzzle has six identical pieces and forms a Platonic solid. The pieces interlock with each other to retain each other in relative positions.

BACKGROUND OF THE INVENTION

Only five Platonic solids exist. These solids include the tetrahedron, cube, octahedron, dodecahedron, and icosahedron. Each solid has non-interpenetrating planar surfaces which are identical, convex regular polygons of a single species. All vertices of each solid are equivalent. The tetrahedron is formed by four equilateral triangular surfaces. The cube is formed by six squares. The octahedron is formed by eight equilateral triangles. The dodecahedron is formed by twelve regular pentagons. The icosahedron is formed by twenty equilateral triangular surfaces. No other Platonic solids exist. Thus, the class of Platonic solids is limited to these five solid configurations. As used in this application, the term "solid" refers to a volume defined by planar surfaces.

Many puzzles have been produced for forming solid objects. Conventional puzzles form solids, including Platonic solids, but use pieces of different shapes such as that disclosed in U.S. Pat. No. 4,323,245 to Beaman. Other puzzles use identical pieces to form various three-dimensional shapes, but do not form a Platonic solid, such as U.S. Pat. No. 3,885,794 to Coffin. Still other puzzles employ identical shapes to form Platonic solids, but their pieces require magnets to hold them together such that they are not interlocked, such as U.S. Pat. No. 3,565,442 to Klein.

Thus, none of the conventional puzzles form a Platonic solid with six identically shaped, three-dimensional pieces which are interlocked to retain the pieces in their proper positions.

SUMMARY OF THE INVENTION

An object of the present invention is to provide a challenging and aesthetically appearing puzzle formed of a plurality of pieces.

Another object of the present invention is to provide a three-dimensional puzzle forming a Platonic solid of six identically shaped interlocking pieces.

A further object of the present invention is to provide a puzzle which is simple and inexpensive to manufacture and of a rugged construction.

The foregoing objects are obtained by a puzzle forming a Platonic solid, comprising six identically shaped, three-dimensional pieces. Each piece has a plurality of planar faces and is formed as a unitary member. The pieces interlock to form the solid and retain the pieces in their relative positions with respective faces in sliding, surface-to-surface contact.

The invention is also obtained where the puzzle consists only of the six identically shaped, three-dimensional pieces.

By use of the term "interlocking", applicant means that the pieces are positioned such that the motion of any piece is constrained by another piece. Thus, the pieces forming the puzzles of the present invention engage one another and hold one another in place by friction alone without the use of additional locking or retaining mechanisms, such as magnets or other faster devices.

Other objects, advantages and salient features of the present invention will become apparent from the following detailed description, which, taking in conjunction with the annex drawings discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Each of the five puzzles of the present invention forms, when assembled, one of the five Platonic solids. Each puzzle comprises six unitary pieces which are identical to the other pieces within that puzzle. The pieces in each of the five puzzles are different.

The form of each piece remains unchanged by a rotation of 180°. Upon assembly, this permits each piece of a puzzle to be located in one of two orientations, as well as in each of the six positions.

The Tetrahedron-Shaped Puzzle

Figure 1:
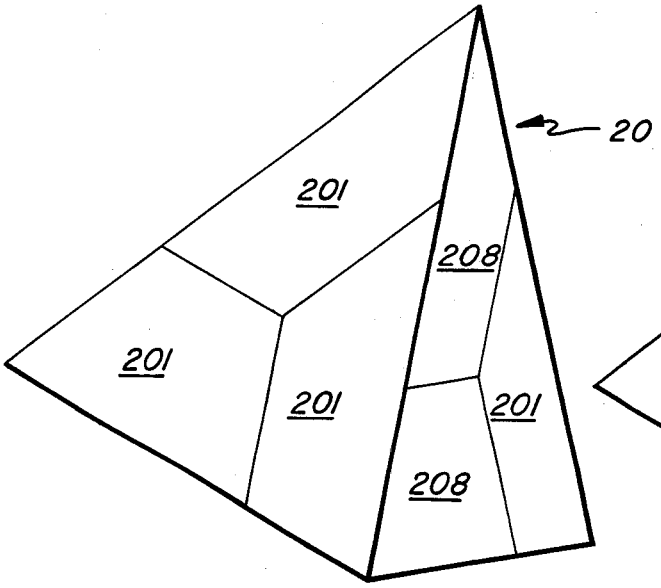
FIG. 1 is a perspective view of a first puzzle according to the present invention in the form of a tetrahedron.
Figure 2:
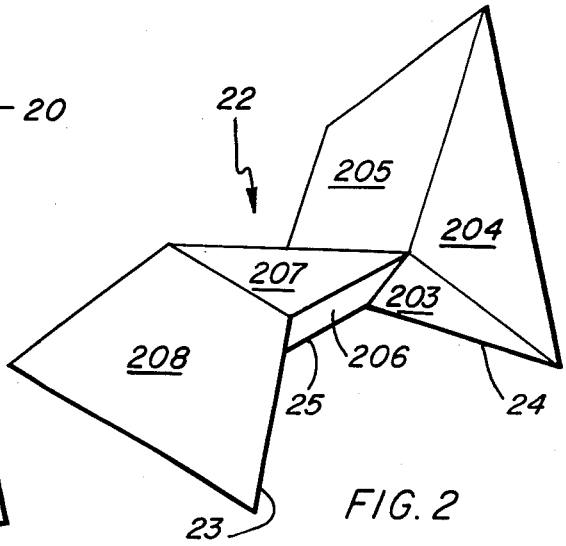
FIG. 2 is a perspective view of one of the pieces of the puzzle of FIG. 1.
Figure 3:
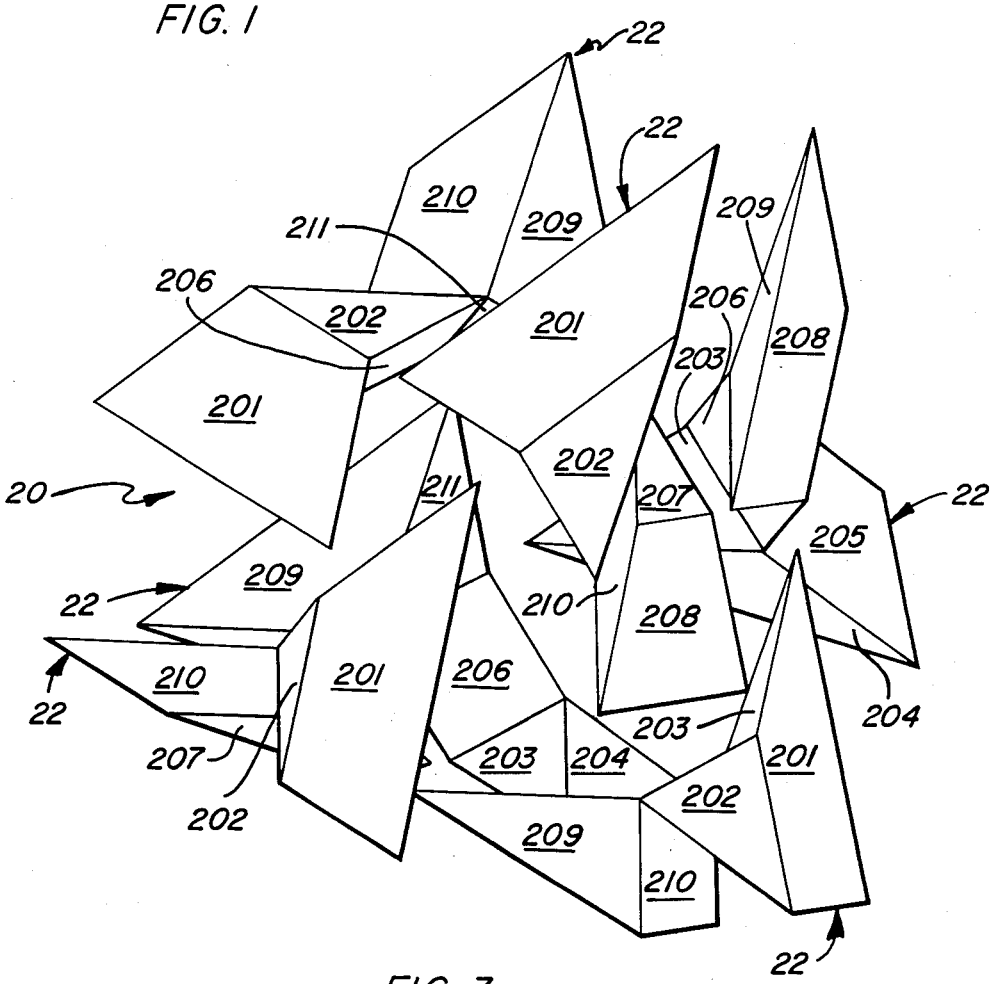
FIG. 3 is an exploded, perspective view of the puzzle of FIG. 1.

Referring to FIGS. 1–3, a puzzle 20 forming a tetrahedron is formed by six identical unitary pieces 22. Each of the six identical pieces has eleven planar faces 201–211, defining end sections 23 and 24 joined by a center section 25. End section 23 includes face 208 in the form of an isosceles trapezoid, (i.e., four-sided polygon with two unequal parallel sides and two equal, angularly oriented sides), face 209 in the shape of an isosceles triangle, (i.e., a triangle where two sides are equal), face 210 in the form of a trapezoid (i.e., four-sided polygon with two parallel sides) with unequal sides, and face 211 in the form of a right triangle. End section 24 includes face 201 in the shape of an isosceles trapezoid, face 203 in the form of a right triangle, face 204 in the form of an isosceles triangle and face 205 in the shape of a trapezoid with unequal sides. Center section 23 comprises two identical faces 202 and 207 in the form of right triangles, and face 206 in the form of a square.

The right angles in triangular faces 202 and 207 are located adjacent faces 201 and 208, respectively. The right angles of triangular faces 203 and 211 are located adjacent to diagonally opposite corners of square 206. Faces 202 and 207 are mutually perpendicular and meet square face 206 at 45° angles. Faces 203 and 211 are mutually perpendicular and meet square face 206 at 135° angles.

In each piece 22, opposite end faces 201 and 208 form the exposed surfaces of the Platonic solid. Each of the four triangular surfaces of the tetrahedron is formed by three of such identical end faces.

The relative orientations of the pieces are shown by the exploded view of FIG. 3. When assembled, the various pieces engage each other in surface-to-surface contact to interlock. Faces 202 and 207 of one piece mate with faces 203 or 211 of two transversely oriented pieces. Square faces 206 face each other in the middle of the solid to form a hollow internal cavity in the shape of a cube. The edge length of this cavity is $1/\sqrt{18}$ times the edge length of a triangular face of the assembled puzzle 20.

The Cube-Shaped Puzzle

Figure 4:
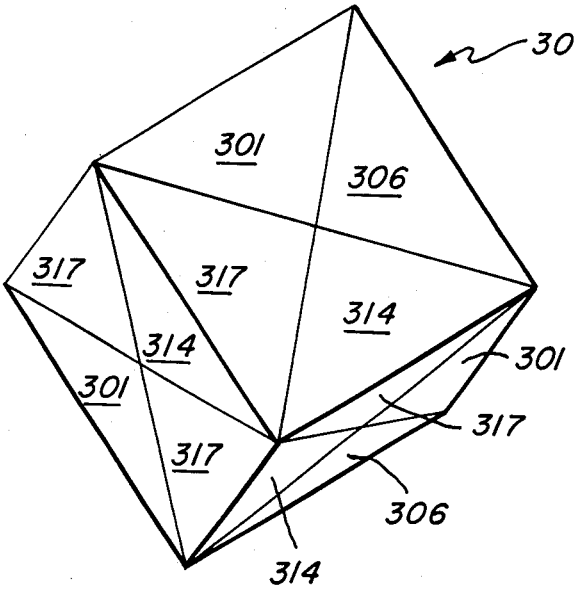
FIG. 4 is a perspective view of a second puzzle according to the present invention in the form of a cube.
Figure 5:
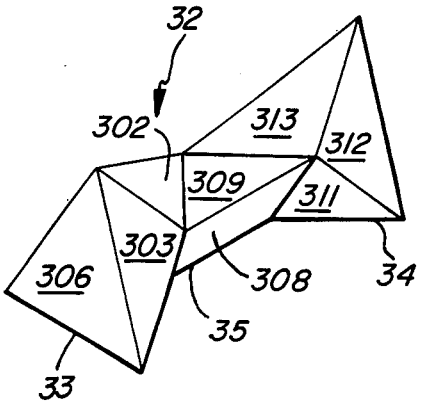
FIG. 5 is a perspective view of one of the pieces of the puzzle of FIG. 4.
Figure 6:
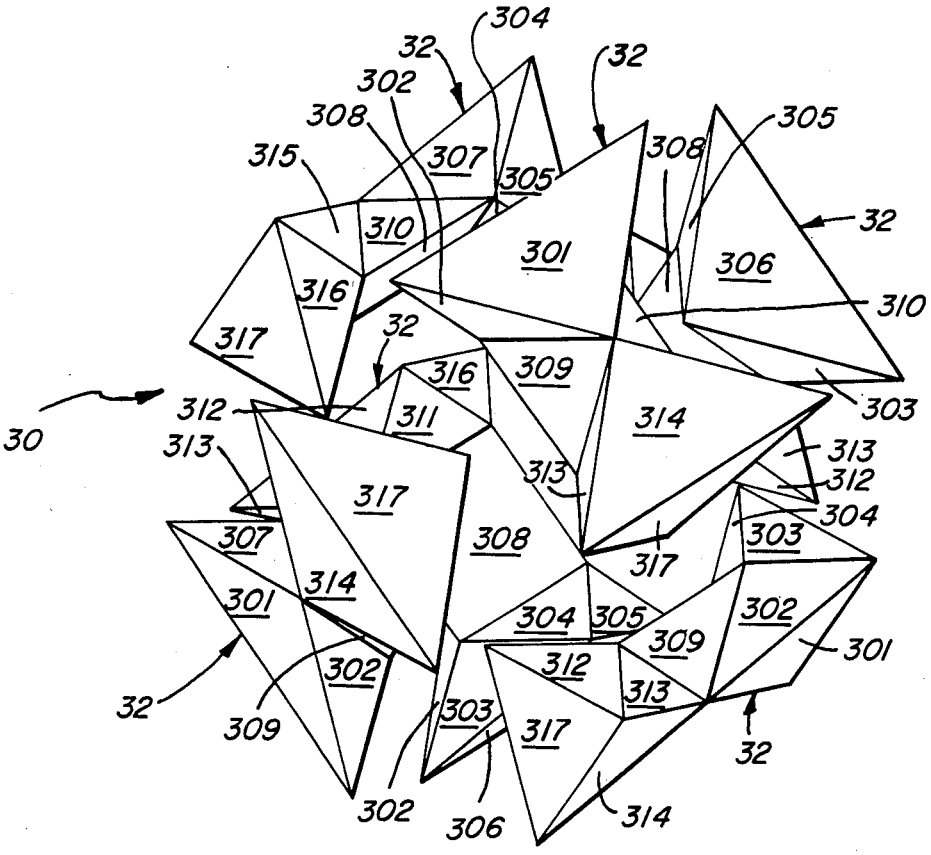
FIG. 6 is an exploded, perspective view of the puzzle of FIG. 4.
Figure 7:
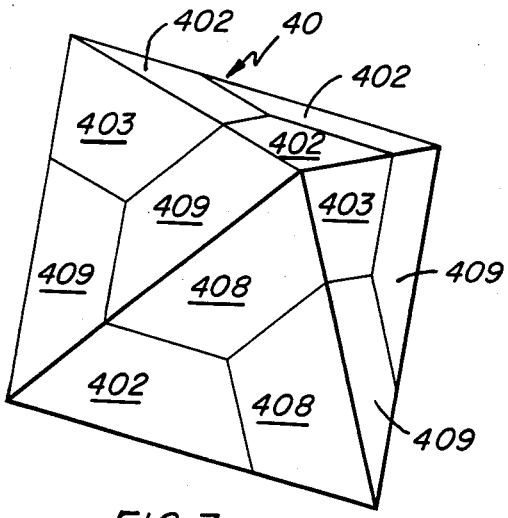
FIG. 7 is a perspective view of a third puzzle according to the present invention in the form of an octahedron.
Figure 8:
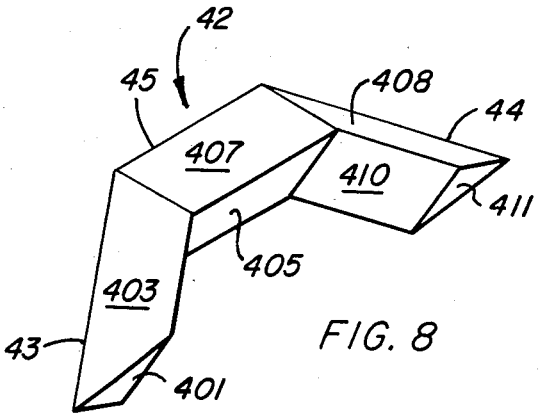
FIG. 8 is a perspective view of one of the pieces of the puzzle of FIG. 7.

Referring now to FIGS. 4–6, a puzzle 30 in the shape of a cube is formed by six identical, unitary pieces 32. Each piece is symmetrical along longitudinal and transverse axes, and is unchanged by a mirror reflection.

Each piece 32 has seventeen planar faces defining end sections 33 and 34 joined by a center section 35. End section 33 has two identical faces 301 and 306 in the form of right isosceles triangles, four identical faces 302, 303, 305 and 307 in the form of isosceles triangles and a face 304 in the form of an isosceles triangle. End section 34 has two identical right isosceles triangular faces 314 and 317, four isosceles triangular faces 312, 313, 315 and 316, and one isosceles triangular face 311. Center section 35 comprises a square face 308 and two identical isosceles triangular faces 309 and 310.

The right isosceles triangular faces 301 and 314 are coplanar and meet at a common apex with their hypotenuses being opposite and parallel. Right isosceles triangular faces 306 and 317 share common hypotenuses with faces 301 and 314, respectively, and are oriented parallel to one another. The isosceles triangular faces 304 and 311 are mutually perpendicular, have their bases on opposite edges of square face 308 and meet square face 308 at 135° angles. Isosceles triangular faces 309 and 310 are mutually perpendicular, have their bases on the other opposite edges of square face 308, and meet square face 308 at 45° angles.

Faces 313, 315 and 317 extend perpendicular to face 314, while faces 302, 306 and 307 extend perpendicular to face 301. Square face 308 is parallel to faces 301 and 314.

In each piece 32, the identical right isosceles triangular faces 301, 306, 314 and 317 form the exposed surfaces of the Platonic solid. Each of the six square surfaces of cube 30 is formed by four such identical faces.

The relative orientations of pieces 32 to form cube 30 are illustrated in the exploded view of FIG. 6. Respective faces engage one another in surface-to-surface contact to interlock the pieces and hold them in their relative positions. Faces 309 and 310 of one piece mate with faces 304 or 311 of two transversely-oriented pieces. In the center of the cube, square faces 308 of each of the six pieces face each other and define an interior cavity in the form of a cube. The edge length of this cavity is ½ times the edge length of a square surface of assembled puzzle 30.

The Octahedron-Shaped Puzzle

Referring to FIGS. 7–10, a puzzle 40 of a Platonic solid in the form of an octahedron is formed by six identical unitary pieces 42. The form of each piece remains unchanged by a mirror reflection.

Each piece has eleven separate planar faces 401–411 defining two end sections 43 and 44 joined by a center section 45. End section 43 is defined by a face 401 in the shape of a right isosceles triangle, two angularly oriented faces 402 and 403 in the form of identical isosceles trapezoids and a rectangular face 404. End section 44 is defined by a right isosceles triangular face 411, two angularly oriented faces 408 and 409 in the shape of identical isosceles trapezoids and a rectangle face 410. Center section 45 is defined by rectangular faces 406 and 407 and square face 405. The center section is triangular in transverse cross section.

Faces 402 and 403 of end section 43 have a common base and meet each other an an obtuse angle. Faces 408 and 409 of end section 44 are angularly oriented at an obtuse angle and have a common base. The common base of faces 402 and 403 is perpendicular to the common base of faces 408 and 409. Trapezoidal face 402 is joined to trapezoidal face 409 by rectangular face 406, while trapezoidal face 403 is joined to trapezoidal face 408 by rectangular face 407. Rectangular faces 404 and 410 are perpendicular and meet square face 405 at angles of 135°. Rectangular faces 406 and 407 are perpendicular and meet square face 405 at 45° angles.

The isosceles trapezoidal faces 402, 403, 408 and 409 of each piece 42 form the exposed surfaces of the Platonic solid. Each of the eight triangular surfaces of the octahedron 40 is formed by three such identical faces.

Figure 9:
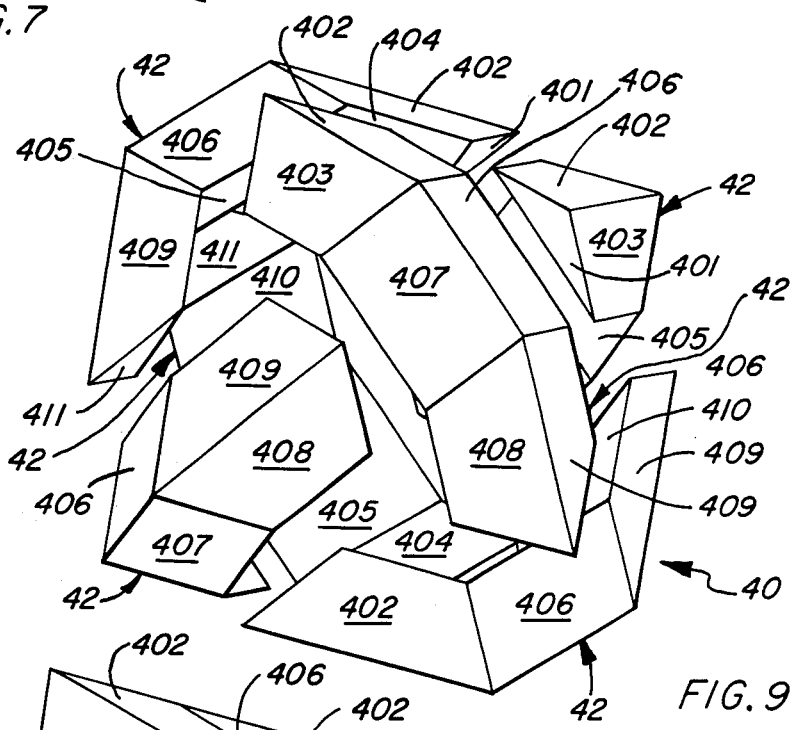
FIG. 9 is an exploded, perspective view of the puzzle of FIG. 7.

The relative orientations of the pieces are illustrated in the exploded view of FIG. 9. In assembling the pieces, oppositely oriented pieces are connected at their right triangular end faces 401 and 411. Rectangular faces 406 and 407 of one piece lie in surface-to-surface contact with rectangular surfaces 404 and 410 of two transversely-oriented pieces 42 to interlock. In the fully assembled configuration, square surfaces 405 define an inner cavity in the form of a cube. The edge length of this cavity is $2/\sqrt{18}$ times the edge length of a triangular surface of assembled puzzle 40.

Figure 10:
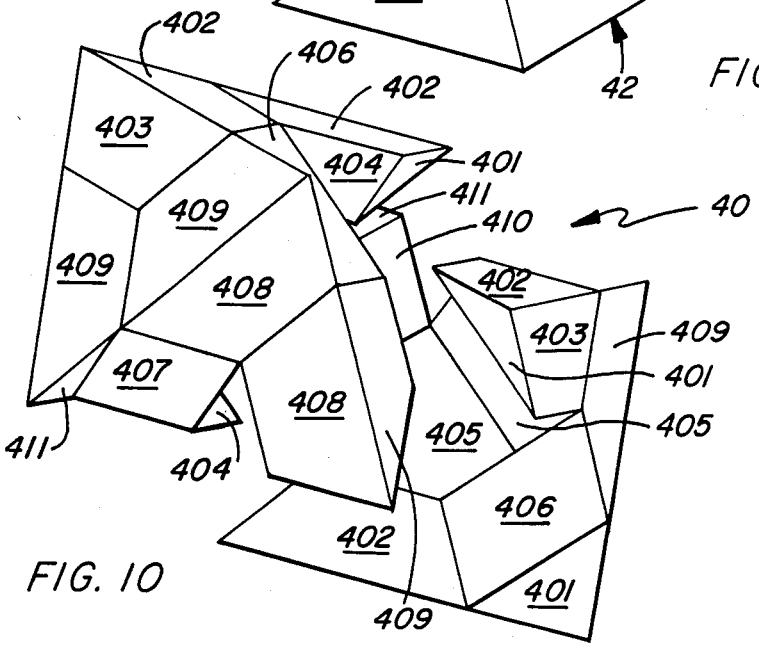
FIG. 10 is a perspective view of the pieces of the FIG. 7 puzzle arranged for reassembly.

FIG. 10 illustrates a mirror image orientation of two sets of three pieces each. Arranging the pieces in this manner facilitates assembly of the puzzle.

The Dodecahedron-Shaped Puzzle

Figure 11:
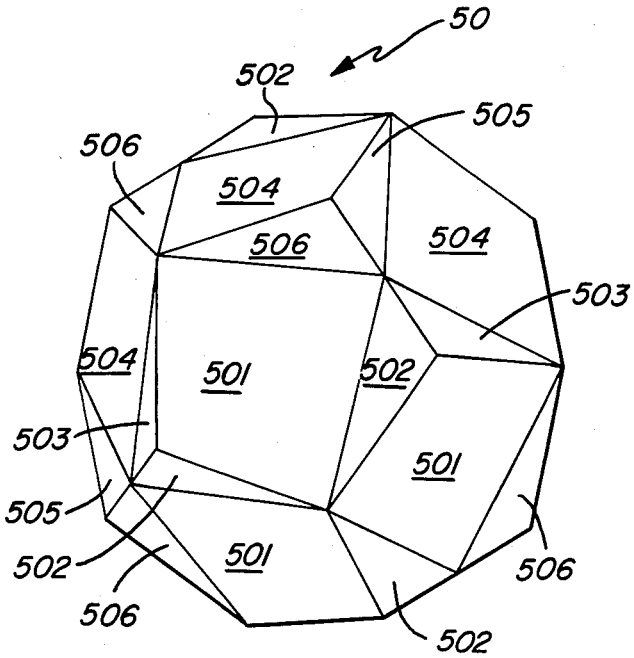
FIG. 11 is a perspective view of a fourth puzzle according to the present invention in the form of a dodecahedron.
Figure 12:
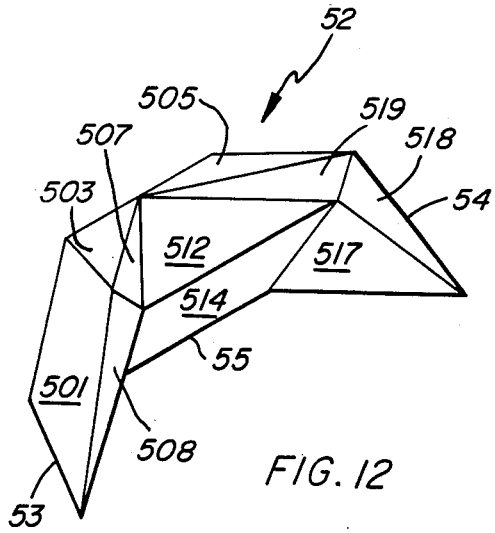
FIG. 12 is a perspective view of one of the pieces of the puzzle of FIG. 11.
Figure 13:
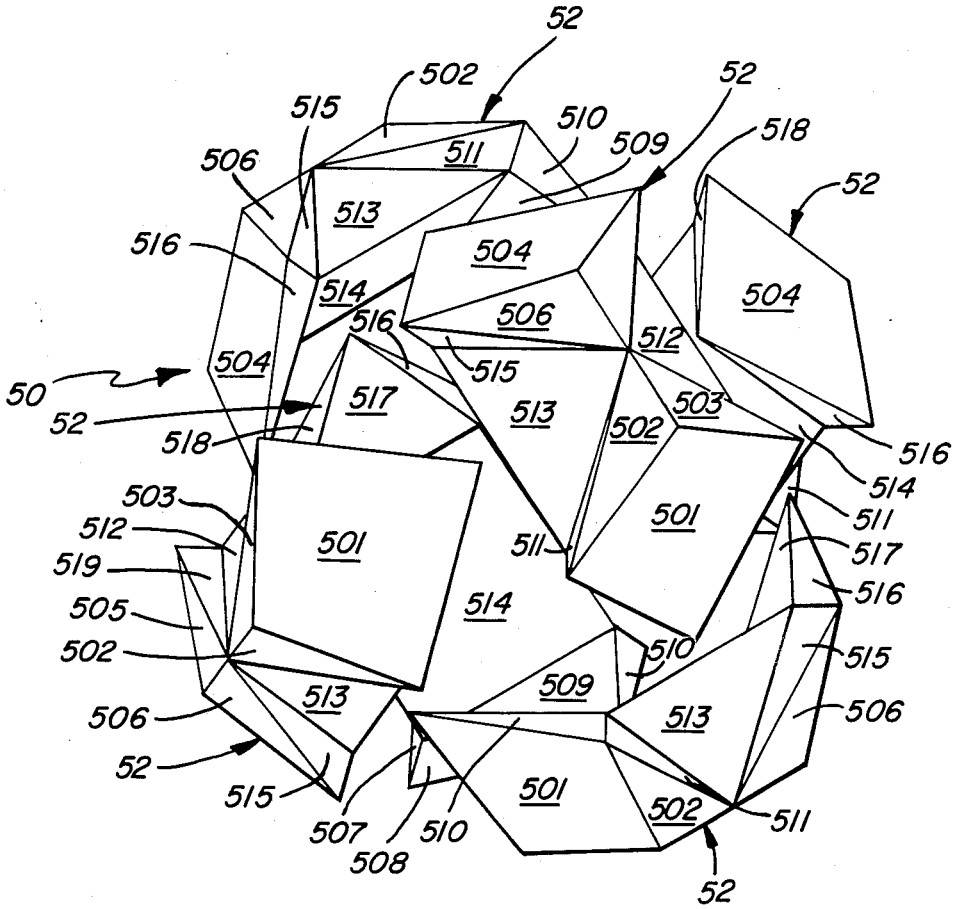
FIG. 13 is an exploded, perspective view of the puzzle of FIG. 11.

Referring now to FIGS. 11–13, a puzzle in the shape of a dodecahedron is formed of six identical unitary pieces 52. The form of each piece remains unchanged by a mirror reflection. Each piece has nineteen separate planar faces defining end sections 53 and 54 joined by a center section 55.

End section 53 includes face 501 in the shape of a trapezium (i.e., a four-sided polygon with no parallel sides) with the adjacent sides being of equal length, two identical faces 502 and 503 in the form of obtuse scalene triangles (i.e., triangles where no two sides are equal and having an included obtuse angular corner), four identical faces 507, 508, 510 and 511 in the form of obtuse scalene triangles, and an isosceles triangular face 509. Similarly, end section 54 is defined by face 504 in the form of a trapezium with two pairs of adjacent sides being of equal length, two identical obtuse scalene triangular faces 505 and 506, four identical obtuse scalene triangular surfaces 515, 516, 518 and 519 and one isosceles triangular face 517. Center section 55 is defined by two isosceles triangular faces 512 and 513 and a square face 514.

Trapezium-shaped face 501 is joined at common edges with obtuse scalene triangles 502 and 503. Similarly, face 504 is joined at common edges with faces 505 and 506. The remaining two equal length edges of faces 501 and 504 have a length equal to the longest edge of the faces 502, 503, 505 and 506. Faces 502 and 503 are angularly oriented along a common edge. Faces 505 and 506 are also angularly oriented along a common edge. Faces 502, 503, 505 and 506 are joined at a common apex. Isosceles triangular faces 512 and 513 are mutually perpendicular and meet square face 514 at an angle of 45°. Isosceles triangular faces 509 and 517 are also mutually perpendicular, and they meet square face 514 at an angle of 135°.

In each piece 52, the identical trapezium-shaped faces 501 and 504 and the two pairs of identical obtuse scalene triangular faces 502, 503, 505 and 506 form the exposed surfaces of the Platonic solid. Each of the twelve pentagonal surfaces of the dodecahedron 50 is formed by one trapezium-shaped face and a pair of obtuse scalene triangular faces.

The relative orientation of the pieces is illustrated in the exploded view of FIG. 13. Faces 509 and 517 lay on faces 512 and 513. When assembled the various pieces engage each other in surface-to-surface contact to interlock in place in the assembled puzzle as shown in FIG. 11. Faces 512 and 513 mate with faces 509 or 517 of two transversely-oriented pieces. The interior of the assembled puzzle forms a cavity in the form of a cube defined by square faces 514. The edge length of this cavity is $(\frac{1}{2}+\cos 36°)$ times the edge length of a pentagonal face of the assembled puzzle 50.

The Icosahedron Puzzle

Figure 14:
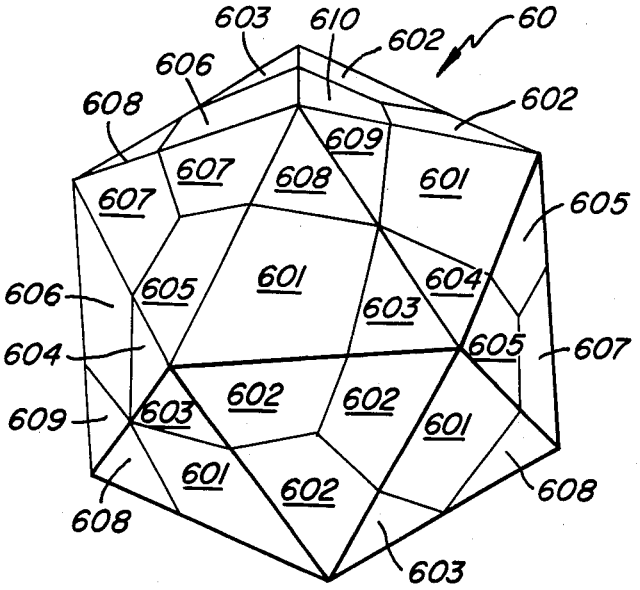
FIG. 14 is a perspective view of a fifth puzzle according to the present invention in the form of an icosahedron.
Figure 15:
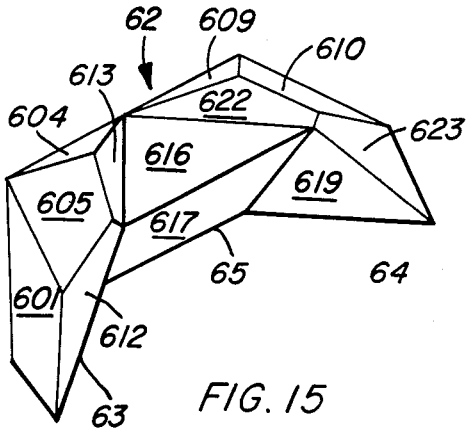
FIG. 15 is a perspective view of one of the pieces of the puzzle of FIG. 14.
Figure 16:
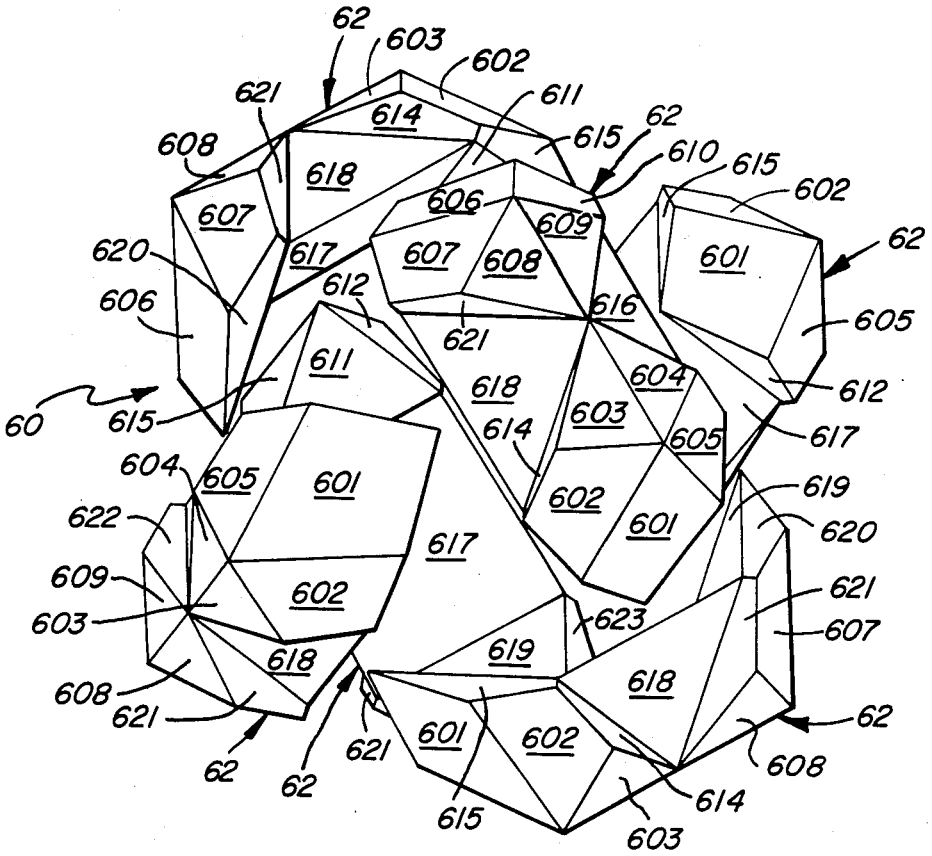
FIG. 16 is an exploded, perspective view of the puzzle of FIG. 14.

Referring to FIGS. 14–16, a puzzle 60 in the form of an icosahedron is formed by six identical unitary pieces 62. Each piece is unchanged by a mirror reflection, and has 23 separate planar faces 601–623 defining end sections 63 and 64 joined by a center section 65.

End section 63 comprises a face 601 in the form of a large trapezium with two pairs of adjacent edges being of equal length, two identical trapezium-shaped faces 602 and 605, two scalene triangular faces 604 and 603, four identical small trapezium-shaped faces 612, 613, 614 and 615, and one isosceles triangular face 611. End section 64 is the mirror image of end section 63. Section 64 is defined by large trapezium-shaped face 606 having two pairs of adjacent sides which are of equal length, two substantially identical trapezium-shaped faces 607 and 610, two substantially identical scalene triangular 608 and 609, four identical, small trapezium-shaped surfaces 620, 621, 622 and 623, and one isosceles triangular face 619. Center section 65 is defined by identical isosceles triangular faces 616 and 618 and square face 617.

The faces of pieces 62 forming the exposed twenty triangular surfaces of the Platonic solid are formed in two sets of five faces each. Each of the two sets of faces are mirror images of each other and are located at opposite ends of each piece. The first set comprises faces 601–605, while the second set comprises faces 606–610. The faces of each set are joined at a common vertex.

In the first set the two identical scalene triangular faces 603 and 604 are angularly oriented along a common base. The two identical trapezium-shaped faces 602 and 605 abut along common edges with faces 603 and 604, respectively. The large trapezium-shaped face 601 shares common edges with and is located between faces 602 and 605. The other set of faces 606–610 is similarly arranged. The two pairs of triangular faces 603, 604, 608 and 609 are joined at a common vertex, along with triangular faces 616 and 618. The small trapezium-shaped surfaces 612–615 extend between the first set of faces and face 616, 618 or 611. Similarly, small trapezium-shaped faces 620–622 extend between the second set of faces and face 616, 618, or 619.

The isosceles triangular faces 616 and 618 are mutually perpendicular and meet square face 617 at an angle of 45°. The isosceles triangular faces 611 and 619 are mutually perpendicular and meet square face 617 at an angle of 135°.

In the assembled puzzle 60, eight of the 20 triangular planar surfaces of the icosahedron are formed by three of the trapezium-shaped faces 602, 605, 607 and 610. The other twelve triangular surfaces of the icosahedron are formed by one of the large trapezium-shaped faces 601 or 606 and two of the scalene triangular faces 603, 604, 608 and 609.

The relative orientations of the pieces are shown in FIG. 16. When assembled, the pieces engage in surface-to-surface contact to interlock. Triangular faces 611 and 619 lie on triangular faces 616 and 618. This permits the small trapezium-shaped surfaces 612–615 and 620–623 to abut. Faces 616 and 618 of one piece mate with faces 611 or 619 of two transversely-oriented pieces. Such engagement interlocks the pieces to retain them in their assembled positions. The interior of the completed puzzle 60 defines a cube-shaped cavity defined by faces 617 of the six pieces 62. The edge length of this cavity is (cos 36°) times the edge length of a triangular surface of assembled puzzle 60.

Each of the puzzles consist of only six identically shaped, three-dimensional pieces. Each piece comprises a unitary member defined by a plurality of planar faces. The pieces interlock with one another without any additional attaching means. Each piece consists of opposite end sections joined by a center section with the faces on the end sections forming the exposed surfaces of the Platonic solids.

Each of the puzzles has been designed in such a way that it can be assembled by arranging its six pieces in two mirror-image groups of three pieces each and by subsequently sliding together these two groups. This mode of assembly is illustrated in FIG. 10 for the octahedron-puzzle. Analogous arrangements are possible for the other four puzzles.

While various embodiments have been chosen to illustrate the invention, it will be understood by those skilled in the art the various changes and modifications therein without departing from the scope of the invention as defined in the appended claims.

What is claimed is:

1. A puzzle forming a Platonic solid, comprising:

six identically shaped, three-dimensional pieces, each of said pieces having a plurality of planar faces and being a unitary member, said pieces interlocking to form said solid and retain said pieces in relative positions with respective faces in sliding, surface-to-surface contact such that each of said pieces can only be removed by simultaneously moving at least one other of said pieces.

2. A puzzle according to claim 1 wherein said Platonic solid is a tetrahedron.

3. A puzzle according to claim 2 wherein each piece has opposite end faces shaped as isosceles trapezoids and forming exposed surfaces of said Platonic solid.

4. A puzzle according to claim 2 wherein each piece has eleven faces.

5. A puzzle according to claim 4 wherein each piece comprises two end sections joined by a center section, each of said end sections having two triangular faces and two trapezoidal faces, said center section having two triangular faces and one square face.

6. A puzzle according to claim 2 wherein each of said pieces has two mirror-image end sections joined by a three-dimensional center section, each said center section being invisible in the assembled puzzle.

7. A puzzle according to claim 6 wherein each said center section has two right triangular faces and one square face.

8. A puzzle according to claim 7 wherein each of said square faces forms a face of an internal cube-shaped void inside the assembled puzzle.

9. A puzzle according to claim 1 wherein said Platonic solid is a cube.

10. A puzzle according to claim 9 wherein each of said pieces comprises opposite and parallel end faces shaped as triangles and two coplanar faces shaped as triangles with common apexes, said end faces and said coplanar faces forming exposed surfaces of said Platonic solid.

11. A puzzle according to claim 10 wherein each of said triangles is a right, isosceles triangle.

12. A puzzle according to claim 9 wherein each of said pieces has seventeen faces.

13. A puzzle according to claim 12 wherein each of said pieces has two end sections joined by a center section, each of said end sections having seven triangular faces, said center section having two triangular faces and one square face.

14. A puzzle according to claim 9 wherein each of said pieces has two mirror-image end sections joined by a three-dimensional center section, each said center section being invisible in the assembled puzzle.

15. A puzzle according to claim 14 wherein each said center section has two isosceles triangular faces and one square face.

16. A puzzle according to claim 15 wherein each of said square faces forms a face of an internal cube-shaped void inside the assembled puzzle.

17. A puzzle according to claim 1 wherein said Platonic solid is an octahedron.

18. A puzzle according to claim 17 wherein each of said pieces comprises two pairs of isosceles trapezoidal faces forming exposed surfaces of said Platonic solid, said trapezoidal faces of each of said pairs having a common base and being angularly oriented, said bases being angularly oriented.

19. A puzzle according to claim 18 wherein said trapezoidal faces of each of said pairs define an obtuse angle therebetween.

20. A puzzle according to claim 18 wherein said pairs of trapezoidal faces are joined by rectangular faces.

21. A puzzle according to claim 17 wherein each of said pieces has eleven faces.

22. A puzzle according to claim 21 wherein each of said pieces has two end sections joined by a center section, each of said end sections having two isosceles trapezoidal faces, one rectangular face and one right triangular face, said center section having three rectangular faces.

23. A puzzle according to claim 17 wherein each of said pieces has two mirror-image end sections joined by a three-dimensional center section, each said center section being invisible in the assembled puzzle.

24. A puzzle according to claim 23 wherein each said center section has two rectangular faces and one square face.

25. A puzzle according to claim 24 wherein each of said square faces forms a face of an internal cube-shaped void inside the assembled puzzle.

26. A puzzle according to claim 1 wherein said Platonic solid is a dodecahedron.

27. A puzzle according to claim 26 wherein each of said pieces comprises opposite end faces shaped as trapeziums and two pairs of angularly oriented side faces shaped as obtuse scalene triangles, said end faces and side faces forming exposed surfaces of said Platonic solid.

28. A puzzle according to claim 27 wherein each said end face is joined at common edges with said side faces of one of said pairs, the remaining two edges of each said end face having a length equal to a longest edge of said side faces, said side faces of each said pair being joined at a common edge.

29. A puzzle according to claim 28 wherein one of said end faces of one of said pieces and one pair of said side faces of another of said pieces form one of twelve pentagonal planar surfaces of said dodecahedron.

30. A puzzle according to claim 26 wherein each of said pieces has nineteen faces.

31. A puzzle according to claim 30 wherein each of said pieces has two end sections joined by a center section, each said end section having one trapezium-shaped face, one isosceles triangular face and six obtuse scalene triangular faces, said center section having two isosceles triangular faces and one square face.

32. A puzzle according to claim 26 wherein each of said pieces has two mirror-image end sections joined by a three-dimensional center section, each said center section being invisible in the assembled puzzle.

33. A puzzle according to claim 26 wherein each said center section has two isosceles triangular faces and one square face.

34. A puzzle according to claim 33 wherein each of said square faces forms a face of an internal cube-shaped void inside the assembled puzzle.

35. A puzzle according to claim 1 wherein said Platonic solid is an icosahedron.

36. A puzzle according to claim 35 wherein each of said pieces comprises two mirror image sets of five faces at each end, said five faces of each said set being joined at a common corner and forming exposed surfaces of said Platonic solid.

37. A puzzle according to claim 36 wherein said faces of each said set comprise two identical scalene triangular faces arranged along a common base, two identical trapezium-shaped faces abutting said triangular faces and one larger trapezium-shaped face between said identical trapezium-shaped faces.

38. A puzzle according to claim 37 wherein said identical scalene triangular faces of each of said sets are joined at a common corner.

39. A puzzle according to claim 38 wherein some of twenty triangular planar surfaces are formed by three of said trapezium-shaped faces; and others of the twenty triangular planar surfaces are formed by one of said larger trapezium-shaped faces and two of said scalene triangular faces.

40. A puzzle according to claim 35 wherein each of said pieces has twenty-three planar faces.

41. A puzzle according to claim 40 wherein each of said pieces comprises two end sections joined by a center section, each of said end sections having seven trapezium-shaped faces and three triangular faces, said center section having two triangular faces and one square face.

42. A puzzle according to claim 35 wherein each of said pieces has two mirror-image end sections joined by a three-dimensional center section, each said center section being invisible in the assembled puzzle.

43. A puzzle according to claim 42 wherein each said center section has two isosceles triangular faces and one square face.

44. A puzzle according to claim 43 wherein each of said square faces forms a face of an internal cube-shaped void inside the assembled puzzle.

45. A puzzle forming a Platonic solid, consisting of: six identically shaped, three-dimensional pieces, each of said pieces having a plurality of planar faces and being a unitary member, said pieces interlocking to form said solid and retain said pieces in relative positions with respective faces in sliding, surface-to-surface contact such that each of said pieces can only be removed by simultaneously moving at least one other of said pieces.

46. A puzzle according to claim 45 wherein each of said pieces consists of two opposite end sections joined by a center section, said faces on said end sections forming exposed surfaces of said Platonic solid.

47. A puzzle according to claim 1 wherein said pieces are arrangeable in two groups of three pieces each, each of said groups being a mirror image of the other such that the two groups can be slid together to assemble the puzzle.

48. A puzzle according to claim 1 wherein said pieces may be arranged in two groups of three pieces each, each of said groups being a mirror image of the other, and the two groups subsequently slid together to assemble the puzzle.

49. A puzzle according to claim 1 wherein each of said pieces comprises two mirror-image end sections joined by a three-dimensional center section, each said center section having at least one square face forming with the square faces of the other center sections an internal cube-shape void in the assembled puzzle.

50. A puzzle according to claim 49 wherein each said center section is completely hidden in the assembled puzzle.

* * * * *